US006310444B1

(12) United States Patent
Chang

(10) Patent No.: US 6,310,444 B1
(45) Date of Patent: Oct. 30, 2001

(54) MULTIPLE LAMP LCD BACKLIGHT DRIVER WITH COUPLED MAGNETIC COMPONENTS

(75) Inventor: Chin Chang, Yorktown Heights (CN)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/636,283

(22) Filed: Aug. 10, 2000

(51) Int. Cl.[7] ..... H05B 41/16

(52) U.S. Cl. ..... 315/282; 315/209 R; 315/219; 315/224; 315/276; 315/291; 323/361

(58) Field of Search ..... 315/209 R, 219, 315/224, 276, 282, 291; 323/361

(56) References Cited

U.S. PATENT DOCUMENTS 4,667,132 * 5/1987 Leale ..... 315/282
5,034,659 7/1991 Taniguchi ..... 315/131
5,331,253 7/1994 Counts ..... 315/209 R
5,519,289 * 5/1996 Katyl et al. ..... 315/224
5,747,943 5/1998 Houk et al. ..... 315/225
6,114,814 * 9/2000 Shannon et al. ..... 315/219

* cited by examiner

*Primary Examiner*—Don Wong
*Assistant Examiner*—Jimmy T. Vu

(57) ABSTRACT

In this invention an inverter for driving multiple lamps has a first circuit for driving a first lamp. The first circuit is made up of a first inductor in series with a first output transformer to drive the first lamp. A second circuit drives a second lamp. The second circuit is made up of a second inductor in series with a second output transformer which drives a second lamp. The first and second transformers are coupled together by a first single magnetic core such that magnetic flux from said first and second transformers is cancelled in the magnetic core to reduce core losses while improving current matching. In a second embodiment the inverter described in the first embodiment further includes a second magnetic core coupling the first and second inductors with minimized leakage inductance. The number of magnetic components for a 2 lamp backlight is then reduced to two.

27 Claims, 4 Drawing Sheets

MULTIPLE LAMP LCD BACKLIGHT DRIVER WITH COUPLED MAGNETIC COMPONENTS

BACKGROUND OF INVENTION

1. Field of the Invention

The invention relates to an inverter for driving multiple lamps in an LCD display. More specifically, the invention relates to the magnetic coupling of inductors and magnetic coupling of output transformers for each of the multiple lamp driver circuits.

2. Description of the Related Art

An LCD based monitor general needs efficient and low profile backlighting for information display. The narrow diameter cold-cathode fluorescent lamp (CCFL), for example the T1 type by Philips, is widely used in the industry. With the increase of monitor size, multiple lamps are needed for the panel illumination. To drive these CCFLs, high frequency electronic ballasts with high efficiency and low profile are in demand. Due to its low losses and low stresses, the voltage-fed half-bridge resonant converter is used to drive the CCFL and other fluorescent lamps. In developing the electronic inverter for multiple CCFLs, people usually prefer to use one single inverter instead of two or more in order to reduce cost and circuit complexity. In this endeavor, the so-called series structure in FIG. 1 and the parallel structure in FIG. 2 are currently used for dual lamp inverters. Comparing these two structures, one can have the following observations.

The series structure in FIG. 1 has a) better lamp current matching due to the series connection of the output transformer primary sides, b) less (3) magnetic components. However, it has higher output transformer turns ratio, which translates to higher primary side winding current, and to more conduction losses. Also, when the output transformer secondary side winding turns increase, the wire size needs to be reduced (e.g. 44AWG) such that the wire fits in the given window area. In addition to contributing to higher conduction losses in the winding, the small size of the wire may cause problems during the manufacturing process.

On the other hand, the parallel structure of FIG. 2 can use a lower turns ratio output transformer. In addition to clear modularity, the secondary side leakage inductance can be reduced and the system performance is improved. However, the parallel structure in FIG. 2 suffers from poor lamp current matching and requires more (4) magnetic components for dual lamps. What is needed is a magnetic component integration approach to overcome the shortfalls of the parallel structure.

SUMMARY OF THE INVENTION

In this invention, two magnetic component integration approaches to overcome the shortfalls of the parallel structure are presented. In the first approach, an inverter for driving multiple lamps has a first circuit for driving a first lamp. The first circuit is made up of a first inductor in series with a first output transformer to drive the first lamp. A second circuit drives a second lamp. The second circuit is made up of a second inductor in series with a second output transformer which drives a second lamp. The first and second transformers are coupled together by a first single magnetic core such that magnetic flux from first and second transformers is cancelled in the magnetic core to reduce core losses. In the second approach the inverter described in the first approach further includes a second magnetic core coupling the first and second inductors with the inductors terminals connected to either enhance the flux or to minimize the flux, thus minimizing leakage inductance or balancing the winding currents, respectively.

In the first approach, the inverter has a core with three parallel interconnected branches or legs. Two of the branches are outer branches and one is an inner branch. The first and second transformers are wound on the outer branches and are coupled by the inner branch such that magnetic flux from the first and second transformers is cancelled. The cancellation is accomplished by the first and second transformers having first and second primaries, respectively, located at opposite ends of their respective cores in an anti-parallel arrangement. Similarly, the first and second transformers have first and second secondaries, respectively, located at opposite ends of their respective cores in an anti-parallel arrangement.

DETAILED DESCRIPTION OF THE INVENTION

Figure 1:
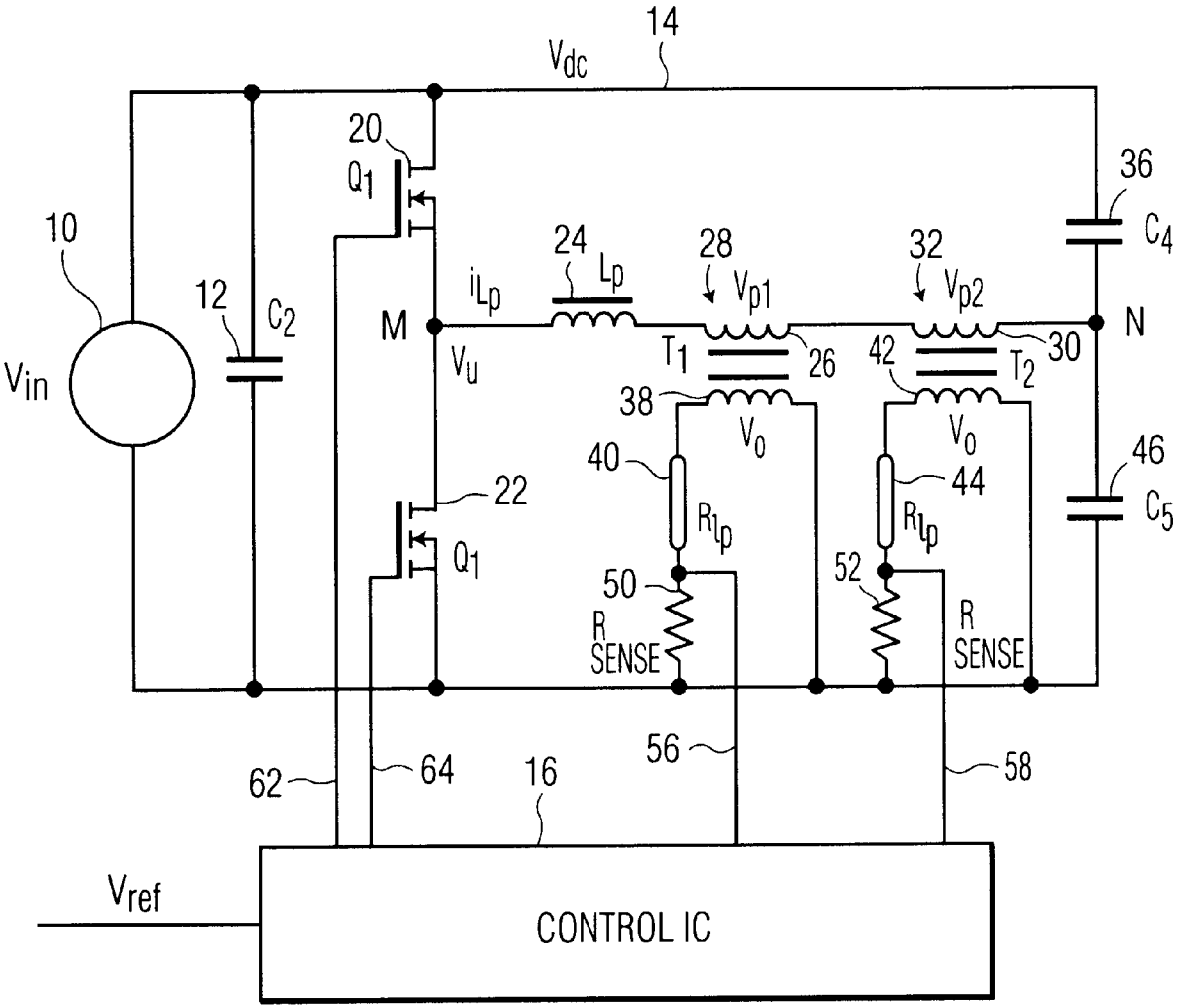
FIG. 1 (PRIOR ART)
FIG. 1 shows a schematic drawing of a prior art LCD backlight inverter with a series structure.

FIG. 1 shows a prior art liquid crystal display (LCD) backlight inverter with a series structure. In this structure, one inverter is used to power two (CCFL) lamps. A voltage source Vin (10) is connected across capacitor C2 (12) to provide a Vdc (14) to power the inverter circuit. A control integrated circuit (IC) (16) controls switchs Q1 (20) and Q2 (22) which are connected across capacitor C2 (12). When switch Q1 (20) is closed, switch Q2 (22) is open and the opposite is true when switch Q1 (20) is open. Inductor Lp (24) has one terminal connected to a common terminal of switches Q1 (20) and Q2 (22) and the other terminal to primary (26) of transformer T1 (28) which is connected in series to primary (30) of transformer T2 (32). The other terminal of primary (30) is connected to one terminal of capacitor C4 (36) which has its other terminal connected to Vdc (14). The secondary (38) of transformer T1 (28) has one terminal connected to lamp (40) and the other terminal to ground. The secondary (42) of transformer T2 (32) has one terminal connected to lamp (44) and the other terminal to ground. Capacitor C3 (46) has one terminal connected to capacitor C4 (36) and the other terminal connected to ground. Sense resistor Rsense (50) has one terminal connected to lamp (40) and the other terminal connected to ground. In the same manner, a second sense resistor Rsense (52) has one terminal connected to lamp (44) and the other terminal connected to ground. Sense resistors Rsense (50), (52) are used to sense the current in lamps (40), (44) respectively. The sensed current is provided to control IC (16) through lines (56) and (58). Control IC (16) also provides control lines (62) and (64) to switches QI (20) and Q2 (22), respectively, to open or close the switches so that one switch is on while the other switch is off and vice versa.

In operation, external voltage source Vin (10) provides a voltage across capacitor C1 (12) which builds up to a voltage Vdc (14). To backlight the LCD screen, control IC (16) provides a control signal on control line (62) to turn on switch Q1 (20). This creates one-half Vdc (14) between points N and M) along with a voltage divider circuit made up of capacitor C4 (36) and C3 (46). Inductor Lp (24) and transformer primaries (28), (32) have one-half Vdc applied across them between points N and M. Transformer primaries (28), (32) provide the signal applied to transformer secondaries (38) and (42) to drive lamps (50) and (52) respectively. In the second half of the high frequency switching cycle, the control signal from control IC (16) is applied to switch Q2 (22) to turn it on. At the same time switch Q1 (20) is turned off. Sense resistors Rsense (50), (52) are used to sense the current in lamps Rlp (40) and (44) respectively, and provide that information to control IC (16) through lines (56) and (58) respectively. The advantages and disadvantages of the series structure are as stated previously in the Background.

Figure 2:
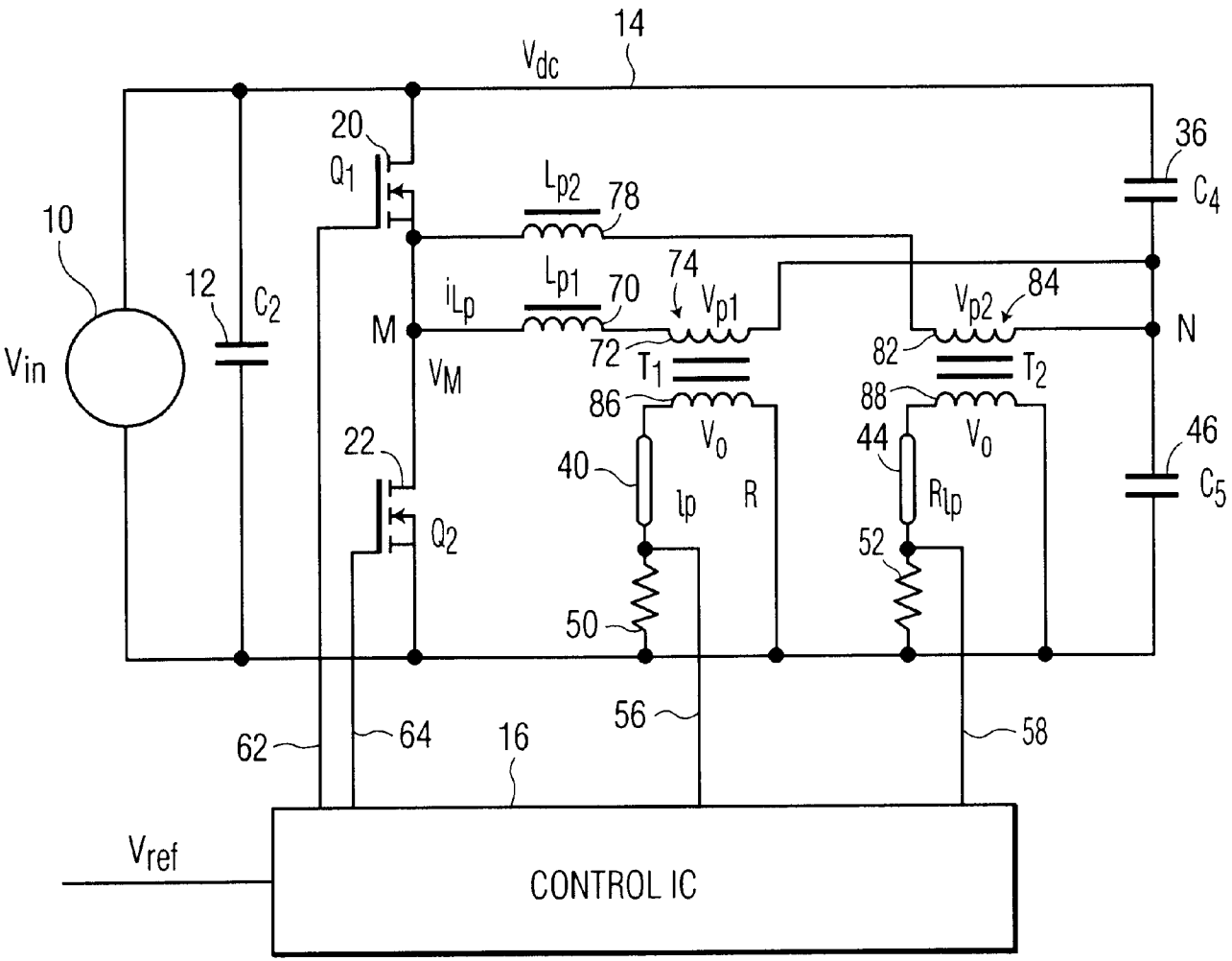
FIG. 2 (PRIOR ART)
FIG. 2 shows a schematic drawing of a prior art LCD backlight inverter with a parallel structure.

FIG. 2 shows a prior art liquid crystal display (LCD) backlight inverter having a parallel structure. Like components of FIG. 1 will retain the same numbers in FIG. 2. In this structure, one inverter is used to power two (CCFL) lamps. An external voltage source Vin (10) is connected across capacitor C2 (12) to provide a Vdc (14) to power the inverter circuit. A control IC (16) controls switches Q1 (20) and Q2 (22) which are connected across capacitor C2 (12). When switching Q1 (20) is closed, switch Q2 (22) is open and the opposite is true when switch Q1 (20) is open. Inductor Lp1 (70) has one terminal connected to a common terminal of switches Q1 (20) and Q2 (22) with the other terminal connected to one terminal of primary (72) of transformer T1 (74). The other terminal of primary (72) is connected to a terminal of capacitor C4 (76) which has its other terminal connected to Vdc (14). Inductor Lp2 (78) has one terminal connected to a common terminal of Q1 (20) and Q2 (22) with the other terminal connected to one terminal of primary (82) of transformer T1 (84). The other terminal of primary (84) is connected to one terminal of capacitor C4 (36) which has its other terminal connected to Vdc (14) the same as primary (72).

The secondary (86) of transformer T1 (74) has one terminal connected to lamp (40) and the other terminal to ground. The secondary (88) of transformer T2 (84) has one terminal connected to lamp (44) and the other terminal to ground. Capacitor C3 (46) has one terminal connected to capacitor C4 (36) and the other terminal connected to ground. Sense resistor Rsense (50) has one terminal connected to lamp (40) and the other terminal connected to ground. In the same manner, a second sense resistor Rsense (52) has one terminal connected to lamp (44) and the other terminal connected to ground. Sense resistors Rsense (50), (52) are used to sense the current in lamp (40) and (44) respectively. The sensed current is provided to control IC (16) through lines (56) and (58). Control IC (16) also provides control lines (62) and (64) to switches Q1 (20) and Q2 (22), respectively, to open or close the switches so that one switch is on while the other switch is off and vice versa.

In operation, voltage source Vin (10) provides a voltage across capacitor C1 (12) which builds up to a voltage Vdc (14). To backlight the LCD screen, control IC (16) provides a control signal on control line (62) to turn on switch Q1 (20). This creates one-half Vdc (14) between points N and M along with a voltage divider circuit made up of capacitor C4 (36) and C3 (46).Inductor Lp1 (70) and transformer primary (72) have one-half Vdc applied across them between points N and M. Similarly, Inductor Lp2 (78) and transformer primary (84) have one-half Vdc applied across them between points N and M. Transformer primaries (72), (82) provide the signal applied to transformer secondaries (86) and (88) to drive lamps (40) and (44) respectively. Sense resistors Rsense (50), (52) are used to sense the current in lamps Rlp (40) and (44) respectively, and provide the information to control IC (16) through lines (56) and (58) respectively. To complete the second half of the high frequency switching cycle, the control signal from control IC (16) is applied to switch Q2 (22) to turn it on. At the same time switch Q1 (20) is turned off. The advantages and disadvantages of the parallel structure are as stated previously in the Background.

Figure 3:
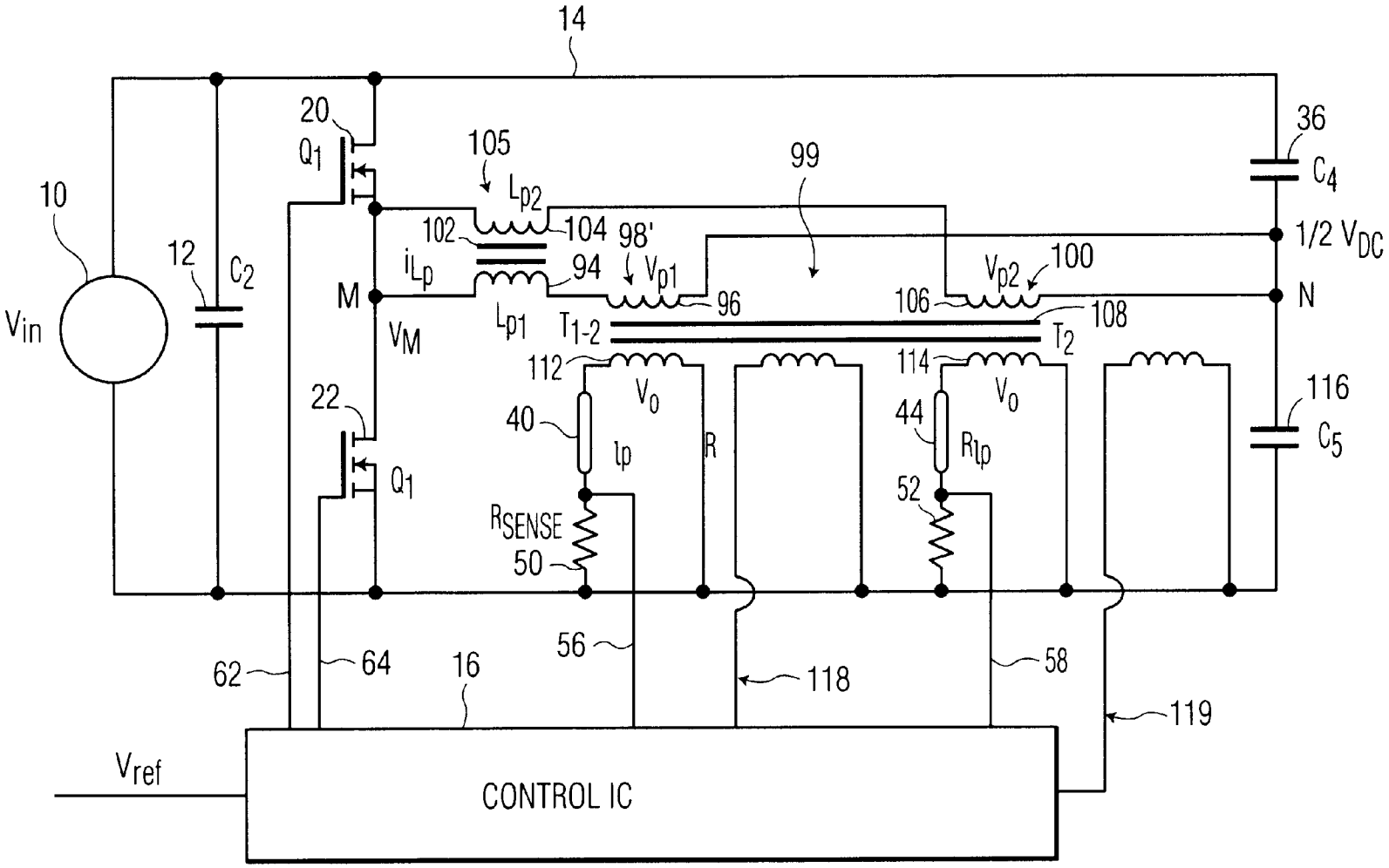
FIG. 3 shows a schematic drawing of the LCD backlight inverter of the invention having a parallel structure with coupled magnetic components.

FIG. 3 shows the improved liquid crystal display (LCD) backlight inverter of the invention. The invention is a parallel structure such as in FIG. 2 with two improvements. The first improvement is the coupling of the inductors with a common magnetic core. The second improvement is the coupling of the transformers with a common magnetic core. Like components of FIG. 2 will retain the same numbers in FIG. 3. In this structure one inverter is used to power two (CCFL) lamps. An external voltage source Vin (10) is connected across capacitor C2 (12) to provide a Vdc (14) to power the inverter circuit. A control IC (16) controls switches Q1 (20) and Q2 (22) which are connected across capacitor C2 (12). When switch Q1 (20) is closed, switch Q2 (22) is open and the opposite is true when switch Q1 (20) is open. Inductor Lr1 (94) has one terminal connected to a common terminal of switches Q1 (20) and Q2 (22) with the other terminal connected to one terminal of primary (96) of winding (98) of transformer T1-2 (99). The latter transformer is made up of transformers (28) and (32) (shown in FIG. 3) coupled together and has two sets of windings (98) and (100) with each set of windings having a primary and a secondary. The other terminal of primary (96) is connected to a terminal of capacitor C4 (36) which has its other terminal connected to Vdc (14). Inductor Lr2 (104) has one terminal connected to a common terminal of switches Q1 (20) and Q2 (22) with the other terminal connected to one terminal of primary (106) of winding (100) transformer T1-2 (99). The other terminal of primary (106) is connected to one terminal of capacitor C4 (101) which has its other terminal connected to Vdc (14) the same as primary (96). Primaries (96) and (106) are both part of transformer T1–2 (99).

Inductors Lr1 (94) and Lr2 (104) are wound on a common magnetic core (102) to form a coupled resonant inductor (105). The two resonant inductors are tightly coupled into a single magnetic core. By constructing the two windings with bifilar magnet wires, the leakage inductance in the coupled resonant inductor is minimized. Furthermore, by connecting the terminals with the magnetic field enhancing direction, the effective inductance is doubled. As a result, the number of turns can be reduced by the square root of two. The conduction loss is reduced accordingly.

In another embodiment of the coupled resonant inductor, the terminals of resonant inductors (94) and (104) are connected with a magnetic field deduction direction such that the fluxes of the resonant inductors oppose. As a result, the currents in both windings are properly balanced. The lamp currents are then also properly balanced.

The secondary (112) of winding (98) of transformer T1-2 (99) has one terminal connected to lamp (40) and the other terminal to ground. The other secondary (114) of winding (100) of transformer T1-2 (99) has one terminal connected to lamp (44) and the other terminal to ground. Capacitor C3 (116) has one terminal connected to capacitor C4 (100) and the other terminal connected to ground. Sense resistor Rsense (50) has one terminal connected to lamp (40) and the other terminal connected to ground. In the same manner, a second sense resistor Rsense (52) has one terminal connected to lamp (44) and the other terminal connected to ground. Sense resistors Rsense (50), (52) are used to sense the current in lamps Rlp (40) and (44) respectively, and provide the information to control IC (16) through lines (56) and (58) respectively. Auxiliary windings (118) and (119) are used to sense the primary voltage and provide a feedback to the control IC (16). Control IC (16) also provides control lines (62) and (64) to switches Q1 (20) and Q2 (22) respectively to open or close the switches so that one switch is on and one switch is off and vice versa.

Figure 4:
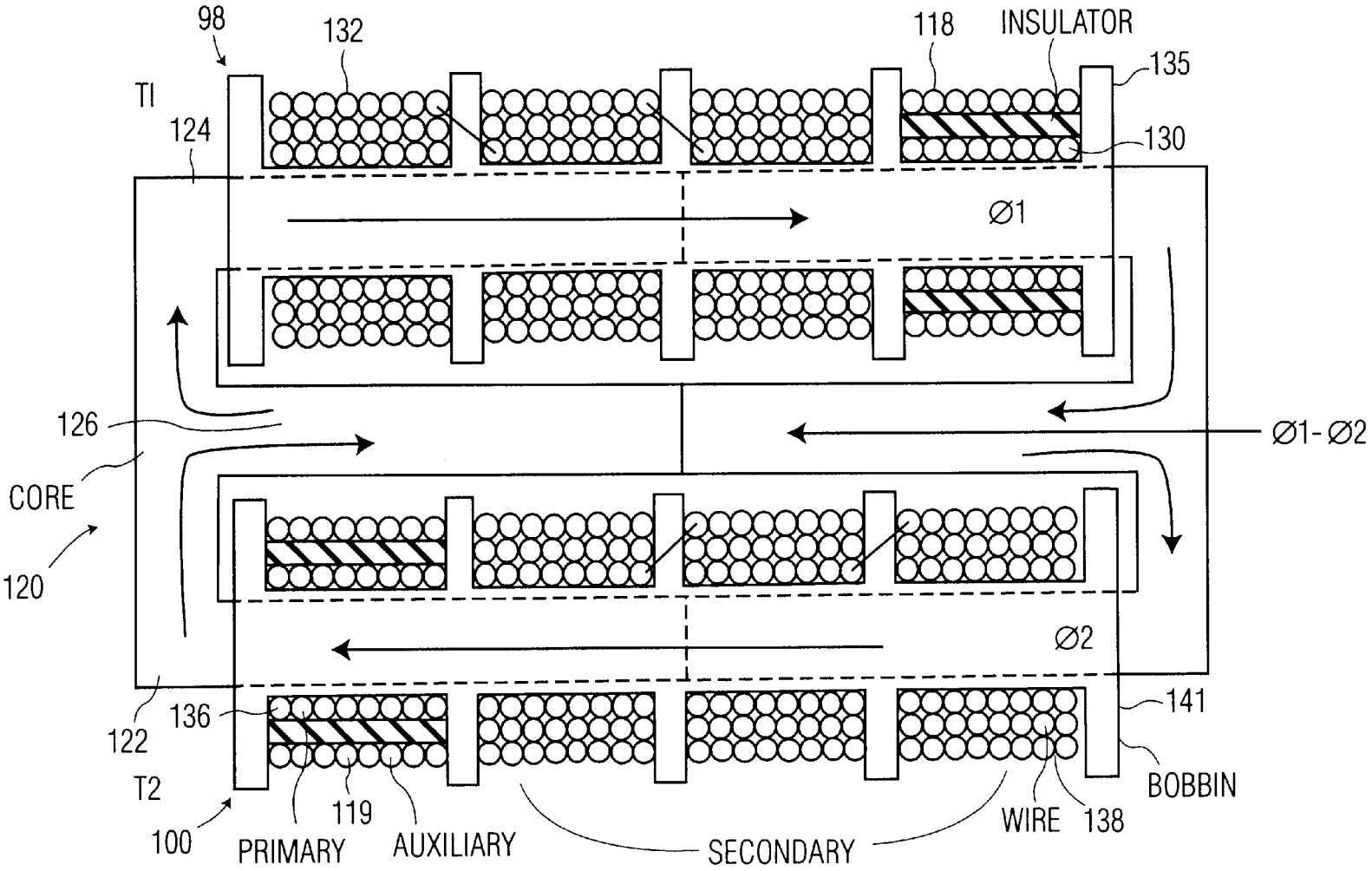
FIG. 4 is a construction diagram of one embodiment of a coupled output transformer.

Windings (98), (100) having primaries (96), (106) and secondaries (112), (114) along with core (108) form coupled output transformer T1-2 (99). The transformer is constructed in the manner shown in FIG. 4. with a typical E core (120) being used. Core (120) has two outer branches (122) and (124) and one inner branch (126). The outer branches (122) and (124) serve as the magnetic cores for transformers (98) and (100) respectively (shown in FIG. 3). The output transformer windings (98) have primary (130), secondary (132) and auxiliary (118) windings assembled in one bobbin (135). Similarly, output transformer windings (100) have primary (136), secondary (138) and auxiliary (119) windings assembled in one bobbin (141). The auxiliary windings (118) and (119) are used to sense the primary voltage and provide a feedback to the control IC (16) (shown in FIG. 3). The inner branch (126) serves as a magnetic core to couple transformers (98) and (100). The primary winding (130) for transformer (98) is in an anti-parallel arrangement with the primary winding (136) for transformer (100) which means they are at opposing ends of their respective cores. Similarly, the secondary and auxiliary windings for transformers T1 (98) and T2 (100) are in anti-parallel arrangements. Assume that the flux in T1 (98) is $\phi 1$ and the flux in T2 (100) is $\phi 2$ as shown in FIG. 4. With the anti-parallel layout of both bobbins, the flux in the center leg is $\phi 1-\phi 2$. This means that the flux in the center leg is substantially reduced. In a perfect matching condition, the flux could approach zero. As a consequence, the core losses in the center leg could reach minimum.

In addition to leading to lower core losses, the coupled output transformer arrangement can be used to greatly reduce the mismatching effect from relatively large core material property variations. The reason is that both windings share the same core. The set to set variation is greatly reduced.

The invented multiple lamp driver for an LCD monitor utilizes coupled magnetic component techniques for both resonant inductors and output transformers although they could be used individually. As a result, the total number of magnetic component is reduced to two, the lamp current matching is naturally achieved in parallel structure and the output transformer turns ratio is kept low. Specifically, by using proper winding and connection techniques, the number of turns in the coupled resonant inductor can be reduced, which results in a smaller size inductor. By proper arrangement of the winding structure in the coupled output transformer, the flux in the center leg is almost cancelled and the output transformer core loss is reduced. More importantly, the structure naturally reduces the effect of core material property tolerance, and therefore improves lamp current matching. With these, a higher efficiency lower cost CCFL lamp driver is obtained. This dual lamp driving circuit topology can serve as a building block for quad or more even number lamps backlight system. Based on the parallel structure, system modularity is obtained.

In addition, the core could have different well known prior art structures other than in FIG. 4. While the preferred embodiments of the invention have been shown and described, numerous variations and alternative embodiments will occur to those skilled in the art. Accordingly, it is intended that the invention be limited only in terms of the appended claims.

What is claimed is:

1. An inverter for driving multiple lamps comprising, a first circuit for driving a first lamp, said first circuit made up of a first inductor in series with a first output transformer, said transformer driving said first lamp, a second circuit for driving a second lamp, said second circuit made up of a second inductor in series with a second output transformer, said transformer driving said second lamp, said first and second transformers coupled together by a first single magnetic core such that magnetic flux from said first and second transformers is cancelled in said magnetic core to reduce core losses while improving lamp current matching.

2. The inverter of claim 1, in which said first and second transformers have first and second primaries positioned on said first magnetic core so as to cancel magnetic flux.

3. The inverter of claim 1, in which said first and second transformers have first and second secondaries positioned on said first magnetic core so as to cancel magnetic flux.

4. The inverter of claim 3, in which said first and second transformers have first and second primaries positioned on said first magnetic core so as to cancel magnetic flux.

5. The inverter of claim 1 including a second magnetic core coupling said first and second inductors with the terminals of said first and second inductors connected with the magnetic field enhancing direction so as to minimize leakage inductance and reduce the effective turns and inductor losses.

6. The inverter of claim 4 including a second magnetic core coupling said first and second inductors with the terminals of said first and second inductors connected with the magnetic field enhancing direction so as to minimize leakage inductance and reduce the effective turns and inductor losses.

7. The inverter of claim 1 having a core with three parallel interconnected branches, with two of said branches being outer branches and one being an inner branch, said first and second transformers being wound on said outer branches and being coupled by said inner branch such that magnetic flux from said first and second transformers is cancelled in the inner branch.

8. The inverter of claim 7, in which said first and second transformers have first and second primaries, respectively, located at opposite ends of their respective cores in an anti-parallel arrangement.

9. The inverter of claim 7 in which said first and second transformers have first and second secondaries, respectively, located at opposite ends of their respective cores in an anti-parallel arrangement.

10. The inverter of claim 9, in which said first and second transformers have first and second primaries, respectively, located at opposite ends of their respective cores in an anti-parallel arrangement.

11. The inverter of claim 10 including a second magnetic core coupling said first and second inductors with minimized leakage inductance.

12. The inverter of claim 1 connected to a voltage source, said first and second transformers have first and second primaries, said voltage source providing a voltage across said first inductor and said first primary and further across said second inductor and said second primary.

13. The inverter of claim 12 including a voltage divider network connected across said voltage source for providing a divided voltage across said first inductor and said first primary, and across said second inductor and said second primary.

14. The inverter of claim 13 including a switching circuit for switching said voltage on and off.

15. The inverter of claim 14 including a control for controlling said switching circuit to switch on and off.

16. The inverter of claim 10 including a voltage source for providing a voltage across said first inductor and said first primary and further across said second inductor and said second primary.

17. The inverter of claim 16 connected to a voltage source, said first and second transformers have first and second primaries, said voltage source providing a voltage across said first inductor and said first primary and further across said second inductor and said second primary.

18. The inverter of claim 17 including a voltage divider network connected across said voltage source for providing a divided voltage across said first inductor and said first primary, and across said second inductor and said second primary.

19. The inverter of claim 18 including a switching circuit for switching said voltage on and off.

20. The inverter of claim 11 including a voltage source for providing a voltage across said first inductor and said first primary and further across said second inductor and said second primary.

21. The inverter of claim 20 connected to a voltage source, said first and second transformers have first and second primaries, said voltage source providing a voltage across said first inductor and said first primary and further across said second inductor and said second primary.

22. The inverter of claim 21 including a voltage divider network connected across said voltage source for providing a divided voltage across said first inductor and said first primary, and across said second inductor and said second primary.

23. The inverter of claim 22 including a switching circuit for switching said voltage on and off.

24. The inverter of claim 1 including a second magnetic core coupling said first and second inductors with the terminals of said first and second inductors connected with the magnetic field deduction direction so as to balance the currents in both inductors and both lamps.

25. The inverter of claim 4 including a second magnetic core coupling said first and second inductors with the terminals of said first and second inductors connected with the magnetic field deduction direction so as to balance the currents in both inductors and both lamps.

26. An inverter for driving multiple lamps comprising, a first circuit for driving a first lamp, said first circuit made up of a first inductor in series with a first output transformer, said transformer driving said first lamp, a second circuit for driving a second lamp, said second circuit made up of a second inductor in series with a second output transformer, said transformer driving said second lamp, a second magnetic core coupling said first and second inductors with the terminals of said first and second inductors connected with the magnetic field deduction direction so as to balance the currents in both inductors and both lamps.

27. An inverter for driving multiple lamps comprising, a first circuit for driving a first lamp, said first circuit made up of a first inductor in series with a first output transformer, said transformer driving said first lamp, a second circuit for driving a second lamp, said second circuit made up of a second inductor in series with a second output transformer, said transformer driving said second lamp, a second magnetic core coupling said first and second inductors with the terminals of said first and second inductors connected with the magnetic field enhancing direction so as to minimize leakage inductance and reduce the effective turns and inductor losses.

* * * * *